US009543709B2

(12) United States Patent
Schreier et al.

(10) Patent No.: US 9,543,709 B2
(45) Date of Patent: Jan. 10, 2017

(54) INSULATING BODY WITH A SHIELDING CROSS

(71) Applicant: Harting Electronics GmbH, Espelkamp (DE)

(72) Inventors: Stephan Schreier, Rahden (DE); Melanie Genau, Luebbecke (DE); Dirk Peter Post, Luebbecke (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/441,636

(22) PCT Filed: Oct. 24, 2013

(86) PCT No.: PCT/DE2013/100366
§ 371 (c)(1),
(2) Date: May 8, 2015

(87) PCT Pub. No.: WO2014/071921
PCT Pub. Date: May 15, 2014

(65) Prior Publication Data

US 2015/0311641 A1 Oct. 29, 2015

(30) Foreign Application Priority Data

Nov. 12, 2012 (DE) ..... 10 2012 022 004

(51) Int. Cl.
*H01R 13/6585* (2011.01)
*H01R 13/6599* (2011.01)
*H01R 13/652* (2006.01)

(52) U.S. Cl.
CPC ..... *H01R 13/6585* (2013.01); *H01R 13/652* (2013.01); *H01R 13/6599* (2013.01)

(58) Field of Classification Search
CPC ..... H01R 13/6585; H01R 13/652; H01R 13/6599
USPC ..... 439/607.02, 607.03, 607.05, 660, 680,439/701
See application file for complete search history.

(56) References Cited

U.S. PATENT DOCUMENTS

| | | | |
|---|---|---|---|
| 5,133,679 | A | 7/1992 | Fusselman et al. |
| 5,213,520 | A | 5/1993 | Casey et al. |
| 5,564,948 | A | 10/1996 | Harting et al. |
| 5,718,606 | A | 2/1998 | Rigby et al. |
| 5,823,825 | A | 10/1998 | Murphy |

(Continued)

FOREIGN PATENT DOCUMENTS

| | | |
|---|---|---|
| CN | 1533602 | 9/2004 |
| CN | 1973408 | 5/2007 |

(Continued)

*Primary Examiner* — Edwin A. Leon
(74) *Attorney, Agent, or Firm* — Jacobson Holman, PLLC.

(57) ABSTRACT

An insulating body, which can be inserted into a chamber of a plug-in connector housing intended for this purpose, has at least one recess for at least one contact element for connecting to a conductor of a cable or a conducting path of a printed circuit board, and a shielding element for electromagnetically shielding the contact element, wherein the insulating body is formed from at least a first component and a second component, wherein the insulating body contains a cavity having a surface formed from the first component, and wherein the first component contains a dopant through which the surface is provided with a conductive coating forming the shielding element.

9 Claims, 4 Drawing Sheets

(56) References Cited

U.S. PATENT DOCUMENTS

| | | | | |
|---|---|---|---|---|
| 6,077,122 | A | 6/2000 | Elkhatib et al. | |
| 6,118,072 | A | 9/2000 | Scott | |
| 6,284,679 | B1 | 9/2001 | Schilling et al. | |
| 6,494,743 | B1 | 12/2002 | Lamatsch et al. | |
| 7,120,005 | B1 | 10/2006 | Luch | |
| 7,140,917 | B1 | 11/2006 | O'Halloran et al. | |
| 7,195,518 | B2 * | 3/2007 | Bert | H01R 4/2441 439/290 |
| 7,425,159 | B2 * | 9/2008 | Lin | H01R 13/6461 439/676 |
| 2005/0277340 | A1 | 12/2005 | Gordon et al. | |
| 2007/0141908 | A1 | 6/2007 | Bert et al. | |
| 2008/0105511 | A1 | 5/2008 | Oh | |
| 2009/0239418 | A1 | 9/2009 | Dennes | |
| 2012/0034809 | A1 | 2/2012 | Reimchen | |
| 2013/0137310 | A1 * | 5/2013 | Genau | H01R 12/724 439/660 |

FOREIGN PATENT DOCUMENTS

| | | |
|---|---|---|
| CN | 101278447 | 10/2008 |
| DE | 3230805 | 4/1983 |
| DE | 4222452 | 1/1993 |
| DE | 9210551 | 12/1993 |
| DE | 4341104 | 1/1995 |
| DE | 9415537 | 2/1996 |
| DE | 19742866 | 12/1998 |
| DE | 19852776 | 5/2000 |
| DE | 19907245 | 8/2000 |
| DE | 69834042 | 12/2006 |
| DE | 102009021594 | 10/2010 |
| DE | 102010051954 | 2/2012 |
| EP | 0693795 | 1/1996 |
| EP | 1858117 | 11/2007 |
| EP | 2194610 | 6/2010 |
| FR | 2921522 | 3/2009 |
| JP | 09-007697 | 1/1997 |
| JP | 09-063703 | 3/1997 |
| JP | 2000-311749 | 11/2000 |
| JP | 2008-163371 | 7/2008 |
| JP | 2008-541354 | 11/2008 |
| JP | 2009503804 | 1/2009 |
| JP | 2009-146770 | 7/2009 |
| JP | 4480207 | 3/2010 |
| KR | 1019920009530 | 6/1992 |
| WO | 2004025723 | 3/2004 |
| WO | WO 2012041310 | 4/2012 |

* cited by examiner

INSULATING BODY WITH A SHIELDING CROSS

The invention relates to an insulating body for inserting into a plug-in connector housing to form a plug-in connector.

Insulating bodies are used in chambers of a plug-in connector housing that are intended for this purpose. As a rule, insulating bodies comprise receptacles for contact elements, to which the conductors of a cable to be connected to the plug-in connector are connected. Alternatively, the contact elements may also be plugged onto and soldered to a printed circuit board.

In data transmission technology, insulating bodies with so-called shielding areas are used. The shielding areas are used to shield at least two conductors of the cable to be connected, and/or the associated contact elements, electromagnetically from each other.

Such insulating bodies are needed to provide multipole plug-in connectors for analogue or digital data transmission, which can be used in shielded designs at frequencies of up to 600 MHz or even higher.

DE 43 41 104 C1 shows a multipole circuit board plug-in connector. In order to electromagnetically shield the plug-in connector from the outside world, it is proposed to provide the insulating body of the plug-in connector with a metallisation. In order to be able to use the plug-in connector at higher data transmission rates, it is further proposed to cover the contact element on the insulating body with metallised caps.

DE 10 2009 021 594 A1 shows an insulating body for plug-in connector housings. The insulating body includes recesses for contact elements and a shielding element for electromagnetically shielding the contact elements. The shielding element is made from metal. In order to connect the metallic shielding element to the insulating body, the insulating body is made from a plurality of individual parts that have to be latched together.

DE 92 10 551 U1 shows a plug-in connector having conductive areas which are made from a doped plastic base material with electrolytically deposited metal particles.

U.S. Pat. No. 6,494,743 B1 shows a plug-in connector attachment housing and an associated insulating body from plastic material. The insulating body is made up of a plurality of insulating body parts which are each inserted into a segment of a metallic shielding cross. The shielding cross is a component of the plug-in connector housing.

The plug-in connectors described above are made up of a large number of individual parts and are therefore complex to assemble.

It is the object of the invention to propose a plug-in connector that is easy to assemble and can at the same time be used in a variety of ways.

The object is achieved by an insulating body (1) that can be inserted into a chamber of a plug-in connector housing intended for this purpose, wherein the insulating body (1) comprises at least one recess (11) for at least one contact element (13), which can be connected to a conductor of a cable to be connected or to a conducting path of a printed circuit board, and wherein the insulating body (1) has a shielding element (20), by means of which the contact element (13) is electromagnetically shielded, characterized in that the insulating body (1) is formed from at least one first component (2) and one second component (10), the insulating body (2) includes a cavity (3), wherein the surface (3, 5) of the cavity (3) is formed by the first component (2), and in that the first component (2) contains a dopant, by means of which the surface (3, 5) of the first component (2) can be provided with a conductive coating in a currentless chemical process, and in that the shielding element (20) is formed from a conductive coating (6) of the first component (2).

Advantageous embodiments of the invention are indicated in the following description.

Figure 1:
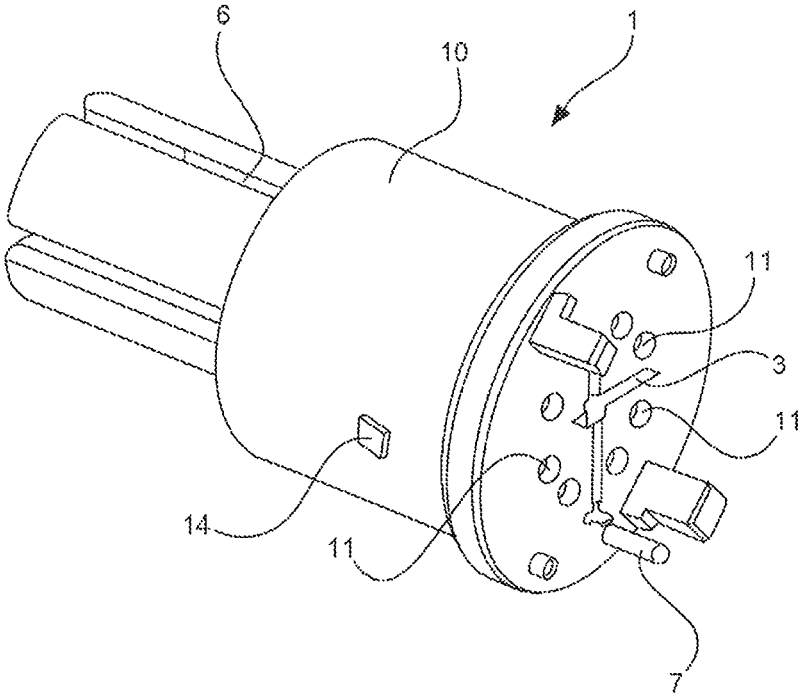
FIG. 1 shows a perspective view of an insulating body.

In the insulating body according to the invention, contact elements can be mounted which will later form the so-called connector face of the plug-in connector. The individual conductors of the cable to be connected to the plug-in connector are connected to the respective contact elements. This may be carried out for example via a crimp connection. However, also any other type of contacting is conceivable. If the insulating body according to the invention is installed as a finished plug-in connector on a printed circuit board, the individual contact elements are as a rule firmly soldered thereto. Other contacting methods, for example press-in-pin, are also conceivable.

The connection of the contact elements of the insulating body to the individual conductors of a cable will be mentioned several times below. However, the insulating body according to the invention is not limited thereto. Contacting of the contact elements on a printed circuit board may equivalently also be provided.

The insulating body is inserted into a chamber of a plug-in connector housing that is intended for this purpose. As a rule, a cable outlet is provided on the plug-in connector housing. The cable to be connected protrudes through the opening of the cable outlet into the inside of the plug-in connector housing.

Within the insulating body, individual contact elements or contact element pairs are electromagnetically shielded from each other by a shielding element. As a rule, two contact elements each are shielded as a pair from the other pairs of two.

As a rule, the insulating body has a cavity, into which a metallic, so-called shielding cross is inserted. The surface of the shielding cross is then in contact with the surface of the cavity. This metallic shielding cross ensures the above-described electromagnetic shielding of at least two contact elements from each other.

The insulating bodies known so far are as a rule surrounded by a metallic contact ring that is in conductive contact with the metallic shielding cross. The contact ring in turn is in conductive (touch) contact with the internal wall of the chamber of the plug-in connector housing.

As a rule, the insulating body is made from a non-conductive material (plastic). As a rule, an insulating body is produced in an injection moulding process, in the course of which plastic material is injected into an injection mould (also referred to as tooling). The injection mould determines here the shape and the surface structure of the insulating body. The insulating body according to the invention is produced in a so-called "two-component injection moulding process".

The insulating body is made of at least two different components, a first and a second component.

At least one of these components, as a rule the first component, is provided with a dopant. The dopant ideally also serves as a catalyst for the metallisation of the surface.

In an advantageous embodiment, the dopant consists of palladium seeds which are mixed into the plastic.

In the finished insulating body produced using the above injection moulding process, at least part of the surface of the first component, which is also referred to as the shielding area, is provided with a conductive coating in a currentless chemical process, in which a metallic substance, preferably copper or a copper alloy, adheres to the dopant. It is also possible to apply other metal compounds onto the copper surface in further working steps, for example in a galvanic process. This conductive coating forms the shielding element of the insulating body according to the invention.

The above-mentioned chemical process is not explicitly a galvanic process that is carried out in an electrolytic bath. Rather, metal particles adhere to the dopant in a currentless manner here, which metal particles grow to a metallic layer on the surface. The method is carried out in a chemical bath in the absence of electrodes. Therefore, this is a so-called currentless chemical process. Subsequently, further metallic coatings can be applied onto the first metallic coating in a galvanic process. Galvanic methods are carried out in electrolytic baths and are therefore not to be regarded as currentless.

The amount of dopant of the first component may here be so low that it is not suitable for a galvanic process. However, a low amount of dopant has the advantage that such a method is more cost-effective because the dopant is expensive.

In a particularly advantageous embodiment, the first (doped) component is provided with a first conductive coating in a currentless chemical (not galvanic) process. This first conductive coating is subsequently coated with at least one second conductive coating in a galvanic process. Further galvanic coating processes may follow and third and fourth conductive coatings may be formed. The superimposed, conductive coatings will then in combination constitute the conductive coating which subsequently forms the shielding element.

In an advantageous embodiment, the insulating body has spring legs that protrude towards the outside and are formed from the first component (with a dopant). In the chemical process, these spring legs are preferably provided with a conductive coating. A further coating in a galvanic bath is here also advantageous. The conductively coated spring legs are in conductive contact with the shielding element. When the insulating body is inserted into the chamber of the plug-in connector housing, these spring legs are also in conductive contact with the housing of the plug-in connector and fulfil the same task as the above-mentioned metallic contact ring in the insulating bodies known so far.

An insulating body according to the invention, including the shielding element (conductive coating), is implemented as an integral module. The contact elements may be directly mounted. There is no need for an additional step for mounting the shielding element or the metallic contact ring.

In an advantageous embodiment of the invention, the cavity extends through the insulating body in a cruciform manner in an axial direction. As a result, also a cruciform metal coating is achieved in the insulating body. This is particularly advantageous for an eight-pole plug-in connector. This allows pairs of two contact elements each to be shielded from each other.

In the case of twelve-pole plug-in connectors it is advantageous to provide for the insulating body to axially extend through the cavity in a star-shaped manner. In the case of a symmetrical division of the individual star arms, again pairs of two contact elements each are shielded from each other.

However, it may also be advantageous to provide a plurality of cavities in the insulating body, which are orientated parallel to each other. As a result, shielding elements that are orientated parallel to each other are obtained. This is particularly advantageous in the case of rectangular insulating bodies.

Depending on the number of contact elements and the technically required shielding, the shape of the shielding element according to the invention may be configured variably. Any shape and extension within the insulating body is technically feasible.

The method for producing the insulating body according to the invention will be described below:

As has already been mentioned, the insulating body is produced in a two-component injection moulding process from at least one first and one second component. At least one of these components is provided with a dopant. Advantageously, the dopant consists of palladium seeds. In conjunction with a subsequent metallic coating, this method is also known as a so-called MID process.

In a first working step, the first component is injected into the injection mould. As a rule, the first component is provided with the above-mentioned palladium dopant. In this case, the first component forms the surface area that is later to form the shielding element.

In a second working step, the second component is injected into the injection mould and partially surrounds the first component, so that the final shape of the insulating body is formed. The surface area for the shielding element is moulded into the first component as early as in the first working step and is not covered by the second component during the second working step.

At this point, the moulded insulating body is provided with a conductive coating in a chemical process. By means of a chemical process that is not described in any more detail, copper is deposited onto the still free surface of the doped component. On this copper layer, further different metal layers can now be applied in further steps, for example in galvanic baths. The finished coating forms the shielding element.

According to the invention, also insulating bodies with just one receptacle for a single contact element may be provided. The shielding area would then ideally envelop the receptacle for the contact element. In this way, a double-shielded, single-pole plug-in connector can be produced using a metallic housing.

Figure 2:
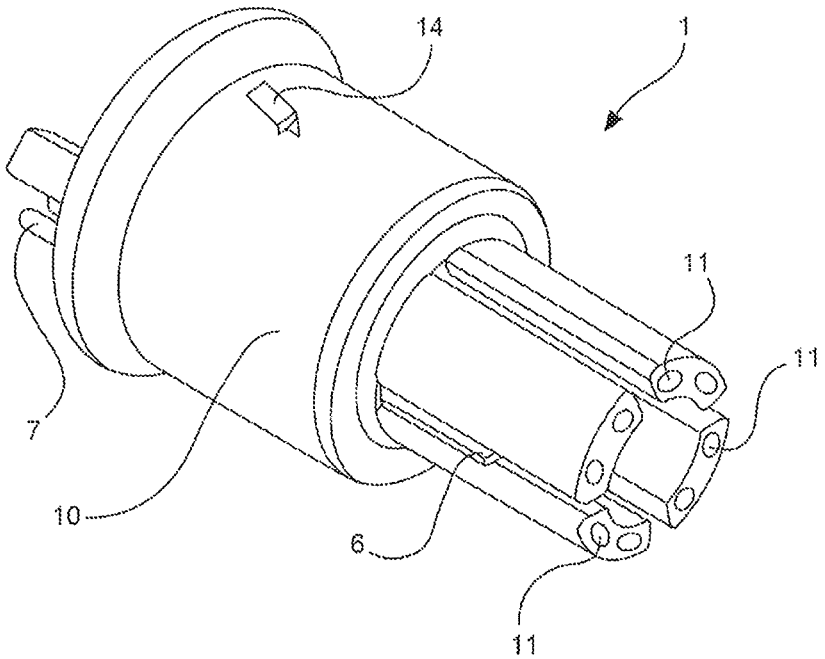
FIG. 2 shows a further perspective view of an insulating body.
Figure 3:
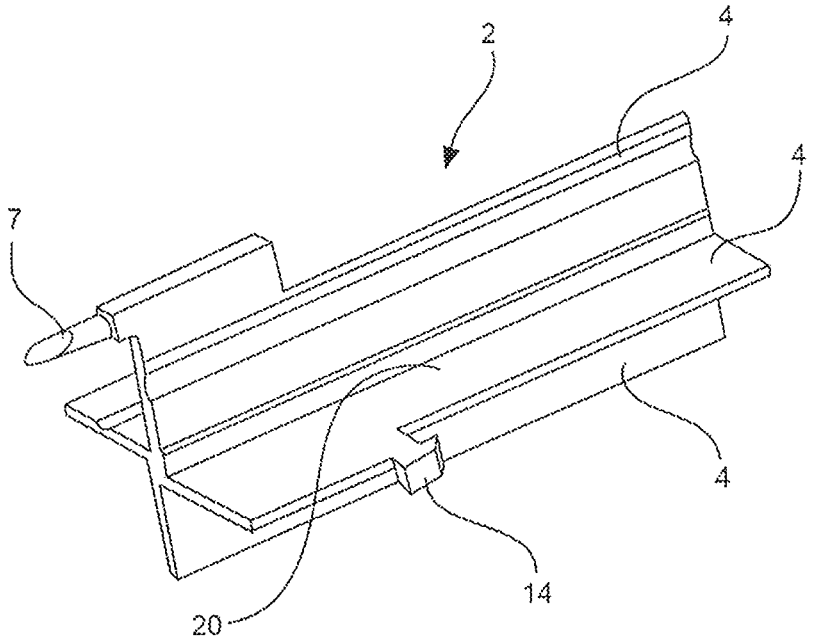
FIG. 3 shows a perspective view of a doped component of the insulating body.
Figure 4:
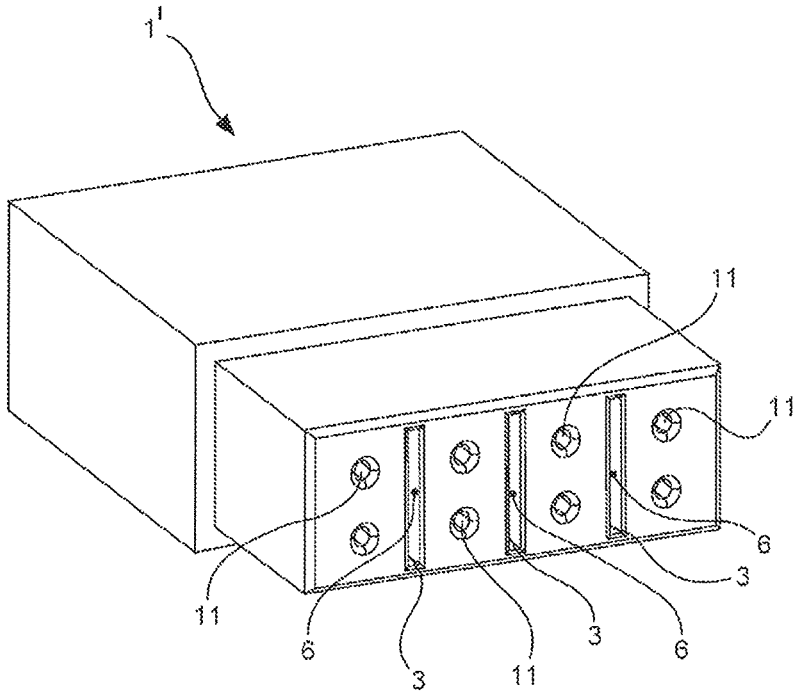
FIG. 4 shows a perspective view of a further embodiment of an insulating body.

An embodiment example of the invention is shown in the drawings and will be explained in more detail below wherein (as set forth above):

FIG. 1 shows a perspective view of an insulating body,

FIG. 2 shows a further perspective view of an insulating body,

FIG. 3 shows a perspective view of a doped component of the insulating body, FIG. 4 shows a perspective view of a further embodiment of an insulating body.

FIG. 1 shows a perspective view of a first embodiment of an insulating body 1 according to the invention.

The insulating body 1 consists of a first component 2 and a second component 10. The first component is provided with a palladium dopant and is initially, in a chemical process, provided with a first metallic layer and subsequently, in galvanic baths, with further metallic coatings, which in combination form a conductive coating 6 that forms the shielding element 20.

The insulating body 1 substantially has a cylindrical shape. On the end side, recesses 11 are provided which are suitable for mounting contact elements (not shown here). A cruciform cavity 3 extends through the insulating body 1. Further, a so-called shielding contact 7 is provided that ensures the contact for shielding transfer and is for example provided for grounding the plug-in connector. To this end, the shielding contact 7 is either connected to the ground conductor of the cable to be connected or to the ground wire of the printed circuit board.

In a particularly preferred embodiment of the invention, the shielding contact 7 is made up of a part of the first material component 2 and the conductive coating 6 located thereon. Alternatively, the shielding contact 7 may also be formed from a separate, metallic contact element.

Spring arms 14 protrude from the lateral surface of the insulation body 1, which spring arms are, when being inserted into a chamber of a plug-in connector, in touching contact with the latter. In a metallic housing, the spring legs 14 are in conductive contact with the housing. The first component 2 forms the elements that are in conductive contact with each other. Altogether, the shielding element 20, the spring legs 14 and the shielding contact are in conductive contact with each other.

The first component 2 of the insulating body 1 substantially has the form of a cross extruded into the space. Two wings 4 of the component 2 form the above-mentioned spring legs 14. The shielding contact 7 is moulded onto a wing 4 that is disposed perpendicularly relative thereto.

A second component 10 is injected around the first component 2. The surface of the first component 2, which is not covered by the material of the second component 10, can subsequently be provided with a conductive coating 6 in a galvanic bath.

FIG. 4 shows a further embodiment of an insulating body 1' according to the invention. The insulating body 1' has a substantially rectangular form. The same reference signs have been used to identify like elements.

Three cavities 3 which are parallel to each other extend through the insulating body 1'. The surface of the cavities 3 is formed by the material of the first, doped plastic component. In a galvanic bath, the surface of the cavity 3 is provided with a conductive coating 6.

The three shielding surfaces 6 which are parallel to each other are conductively connected and are also in conductive contact with a shielding contact element (not shown here). In this embodiment, too, spring elements (not shown here) may be provided, which are in conductive contact with the plug-in connector housing.

All the features of the different embodiments disclosed in this document may be combined with each other in any desired way without deviating from the underlying inventive concept.

LIST OF REFERENCE NUMERALS

1 insulating body
2 First component
3 Cavity
4 Wing
6 Conductive coating
7 Shielding contact element
10 Second component
12 Pair of two
14 Spring arm
20 Shielding element

The invention claimed is:

1. An insulating body insertable into a housing to form a plug-in connector for a cable or a printed circuit board and comprising a dopant-containing first component having an axially oriented shape and a surface coating of multiple, stacked conductive layers of more than one conductive material, a non-conducting second component including therethrough (i) an axially oriented cavity receiving, and matching the shape of, the surface coated first component and (ii) parallel to the cavity, a least one recess for mounting therein an electrical contact for connecting an electrical conductor of the cable or printed circuit board, wherein the surface coating layers together constitute an electromagnetic shield for the contact element when received in the recess.

2. The insulating body of claim 1 formed as an integral module.

3. The insulating body of claim 1, wherein the surface coating comprises (i) a copper or copper alloy layer, or stack thereof, chemically deposited on the surface, (ii) a nickel or nickel alloy layer, or stack thereof, chemically deposited on the copper or copper alloy layer, or stack thereof, and (iii) a gold or gold alloy layer, or stack thereof, galvanically deposited on the nickel or nickel alloy layer, or stack thereof.

4. The insulating body of claim 1, wherein the surface-coated first component and the cavity have matching, axially oriented cruciform shapes.

5. The insulating body of claim 1, wherein the surface-coated first component and the cavity have matching, axially oriented star shapes.

6. The insulating body of claim 1, wherein the dopant contains palladium seeds.

7. The insulating body of claim 1, wherein the surface coating comprises, first, a copper or copper alloy layer chemically deposited on the surface.

8. The insulating body of claim 1, wherein one or both of the first and second components is formed from a plastic material.

9. The insulating body of claim 1 further comprising a shielding contact ground conductively connected to the electromagnetic shield.

* * * * *